United States Patent [19]

Nagano et al.

[11] 3,984,001

[45] Oct. 5, 1976

[54] BUBBLE-DISPERSING APPARATUS

[75] Inventors: Ikuo Nagano; Akira Kimura, both of Hino; Yoko Onishi, Tokyo, all of Japan

[73] Assignee: Mitsui Mining & Smelting Co., Ltd., Tokyo, Japan

[22] Filed: Mar. 20, 1975

[21] Appl. No.: 560,548

[30] Foreign Application Priority Data

Mar. 25, 1974 Japan ..... 49-33214
Mar. 25, 1974 Japan ..... 49-33215

[52] U.S. Cl. ..... 209/3; 209/169; 261/93; 259/23; 259/96

[51] Int. Cl.[2] ..... B03D 1/16

[58] Field of Search ..... 209/168–170, 209/3; 261/87, 93; 210/44, 219–221; 162/4, 55; 259/8, 23, 24, 96

[56] References Cited

UNITED STATES PATENTS

| | | | |
|---|---|---|---|
| 2,243,309 | 5/1941 | Daman et al. | 261/93 |
| 2,246,560 | 6/1941 | Weinig et al. | 209/169 X |
| 2,423,456 | 7/1947 | Logue | 209/169 X |
| 2,944,802 | 7/1960 | Daman | 209/169 X |
| 3,050,188 | 8/1962 | Nisser et al. | 209/170 |
| 3,820,759 | 6/1974 | Hege | 259/8 X |
| 3,872,010 | 3/1975 | Nagahama | 209/169 X |

FOREIGN PATENTS OR APPLICATIONS

| | | | |
|---|---|---|---|
| 970,701 | 7/1949 | Germany | 209/170 |

*Primary Examiner*—Frank W. Lutter
*Assistant Examiner*—Ralph J. Hill
*Attorney, Agent, or Firm*—Woodhams, Blanchard and Flynn

[57] ABSTRACT

A bubble-dispersing apparatus, which comprises a tank for containing a liquid or a mixture of liquid and solid, a vertical rotary shaft installed in said tank and connected with a power source, a fixing plate installed on the lower part of said rotary shaft and extending perpendicular thereto, stirring blades installed on the bottom face of said fixing plate, plural radially disposed guide blades surrounding the rotation zone of said stirring blades and located practically on the same horizontal level as that of said stirring blades by means of a frame whose top is closed, and a gas supply pipe installed beneath and in confronting relationship to said stirring blades.

4 Claims, 10 Drawing Figures

BUBBLE-DISPERSING APPARATUS

BACKGROUND OF THE INVENTION

The present invention relates to a bubble-dispersing apparatus for dispersing a large quantity of bubbles in a tank containing a fluid while maintaining said fluid contained in the tank a stationary state, which apparatus is suitable for use in the flotation/separation operation for substances having a relatively small specific gravity, particularly in the case of the sorting of waste plastics or the de-inking of wastepaper.

As the generally known art of separating and recovering a specific solid from a fluid containing various solids mixed therein, there is an art of effecting flotation/separation by taking advantage of the fact that different kinds of solids have different bubble adsorption functions according to the properties of the surfaces of solids so that one solid can be floated and separated from other solids by virtue of the buoyancy of the bubbles. As this art utilizes the adsorbancy of bubbles to the surface of solids as stated above, it is necessary to prevent, as far as possible, the occurrence of a dynamic state of the fluid, such as flowing, oscillation or vibration of the fluid, which constitutes a main obstruction to the adsorption of bubbles to the surfaces of solids or separation of bubbles from the surfaces of solids after they have been adsorbed thereto. Accordingly, the extent to which the fluid can be maintained in a stationary state under the condition of effecting the dispersion of bubbles constitutes an essential point in determining the exactitude of a flotation/separation operation.

To cite a conventional apparatus devised by applying the foregoing art of effecting flotation/separation, there is the apparatus for the purpose of sorting ores having a relatively great specific gravity.

In the case of this apparatus too, it is desirable to maintain the fluid admixed with various solids within the tank in a stationary state as far as possible. But because ores having greater specific gravity are apt to precipitate and to be deposited on the bottom of the tank, the apparatus is devised to stir the fluid intensely at the sacrifice of maintaining the stationary state of the fluid to some extent in order to maintain said ores in a floating state within the fluid. On the other hand, in the case of effecting separation/flotation of substances having a relatively small specific gravity such as those mentioned above, there is little fear of precipitation of the object substances and stirring of the fluid is not particularly required, and accordingly, the influence of the bubble-dispersing apparatus per se on the fluid is very important, so that the construction of the apparatus is required to be such that it will not impair the stationary state of the fluid as far as possible, and especially it will not disturb the stationary state in the forth layer formed on the surface of fluid as well as in the bubble-ascending zone extending from the lower part of the tank to said surface of the fluid.

However, there has not yet been developed any suitable apparatus for the purpose of dispersing bubbles under a fluid in such conditions as discussed above.

Under such circumstances, the principal object of the present invention is to provide a bubble-dispersing apparatus which will exactly meet the foregoing requirements.

Another object of the present invention is to provide a bubble-dispersing apparatus, which comprises a tank for containing a fluid, a vertical rotary shaft installed in said tank and connected with a power source, a fixing plate installed on the lower part of said rotary shaft and extending perpendicular thereto, stirring blades installed on the bottom face of said fixing plate, plural radially disposed guide blades surrounding the rotation zone of said stirring blades and located practically on the same horizontal level as that of said stirring blades by means of a frame whose top is closed, and a gas supply pipe installed beneath and in confronting relationship to said stirring blades, whereby a gas supplied to the tank through said gas supply pipe while rotating said stirring blades can be split into bubbles with relatively small diameters, further split into bubbles with lesser diameter by the shearing force generated between the stirring blades and the guide blades and dispersed radially and uniformly in the tank through the guide blades, while the fluid that flows out radially from the guide blades into the ascending zone circulates along with the ascending current of fluid generated by the pumping action of the stirring blades together with the gas being blown out of the gas supply pipe, and the kinetic energy thereof is absorbed and consumed while thus circulating, so that no influence of the current of fluid is exerted upon the upper part of tank and the stationary state of the fluid thereat can be maintained.

A further object of the present invention is to provide a bubble-dispersing apparatus, which comprises a solid-dispersing mechanism consisting of a vertical rotary shaft installed in a tank for containing a fluid and connected with a power source, a fixing plate installed on the lower part of said rotary shaft and extending perpendicular thereto, stirring blades installed on the top face of said fixing plate, plural radially disposed guide blades surrounding the rotation zone of said stirring blades and located practically on the same horizontal level as that of said stirring blades by means of a frame, and a solid supply pipe installed above said stirring blades so as to be in front thereof, and a bubble-dispersing mechanism disposed beneath said solid-dispersing mechanism and consisting of a fixing plate installed on the same rotary shaft and extending perpendicular thereto, stirring blades installed on the bottom face of said fixing plate, plural radially disposed guide blades surrounding the rotation zone of said stirring blades and located practically on the same horizontal level as that of the stirring blades by means of the frame, and a gas supply pipe installed beneath and in confronting relationship to said stirring blades, whereby a gas supplied to the tank through said gas supply pipe while rotating said stirring blades can be first split into bubbles with relatively small diameters, further split into bubbles with lesser diameters by the shearing force generated between the stirring blades and the guide blades and dispersed radially and uniformly in the tank along with the fluid through the guide blades, and said bubbles are separated from the current of fluid and ascend in the tank, while the current of fluid comes to circulate by virtue of the pumping action pursuant to the rotation of the stirring blades as well as the ascending current of fluid generated by the gas being blown out of the gas supply pipe, and the kinetic energy of fluid is absorbed in the surroundings of the stirring blades so that not influence is exerted upon the fluid in the upper part of the tank, and solids are automatically taken into the tank through the solid supply pipe by the sucking action pursuant to the rotation of the solid-stirring blades, are dispersed uniformly in the tank by means of said stirring blades as well as solid guide blades, collide with bubbles ascending from beneath and absorb them onto their surface, thereby to make a specified solid float and separate from other solids.

DETAILED DESCRIPTION OF THE INVENTION

Hereunder will be given an elucidation of the present invention with reference to preferred embodiments thereof shown in the appended drawings.

Figure 1:
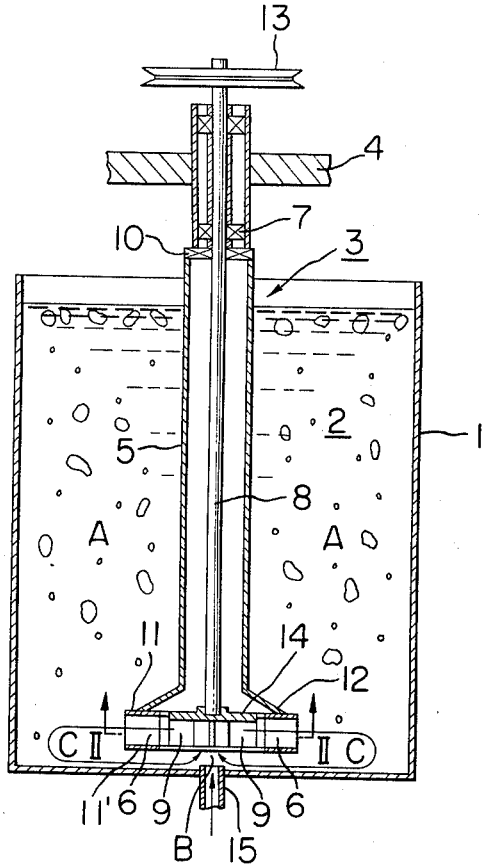
FIG. 1 is a vertical sectional view of the first embodiment of the present invention.

In FIG. 1, the reference numeral 1 denotes a tank, 2 denotes a liquid or a mixture of liquid and solid (with a volume of usually less than 3 $cm^3$), and 3 denotes the main body of a bubble-dispersing apparatus which is installed within said tank 1 by means of the frame 4 installed above the tank 1.

Figure 3:
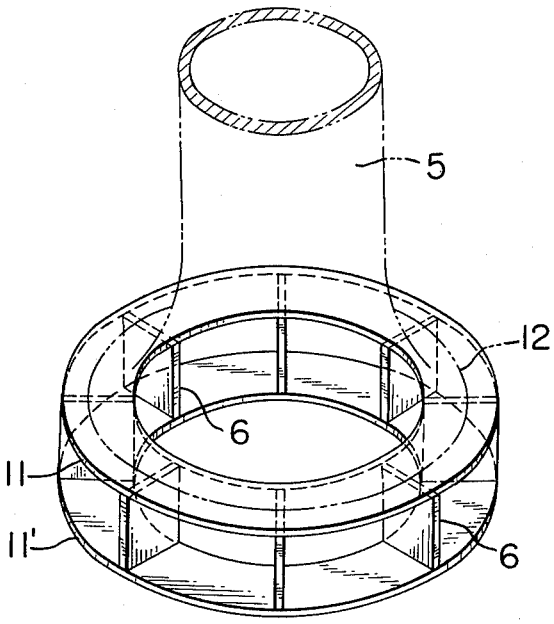
FIG. 3 is a perspective view, on an enlarged scale, of the guide blades of the apparatus shown in FIG. 1.

The main body 3 is composed of a hollow cylindrical stand pipe 5, guide blades 6 which are equipped on the lower end portion of said stand pipe 5, a rotary shaft 8 which is rotatably supported in said stand pipe 5 by means of a bearing 7, and stirring blades 9 installed on the lower end of said rotary shaft 8. The upper end of said stand pipe 5 is closed by means of a seal member 10, while the lower end thereof is expanded to form a trumpet-shape. Plural guide blades 6 are radially fixed between a pair of annular fixing plates 11, 11' which are placed one above the other with spacing therebetween in such a fashion as shown in FIG. 3, and are integrally fixed to the lower end edge 12 of the stand pipe 5 through the upper plate 11 of said pair of annular fixing plates.

Figure 4:
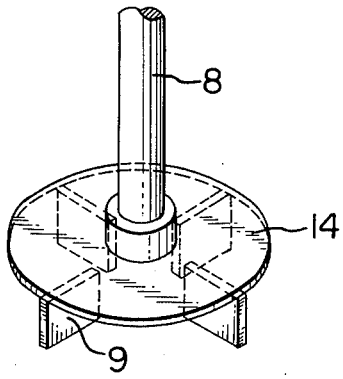
FIG. 4 is a perspective view, on an enlarged scale, of the stirring blades of the apparatus shown in FIG. 1.

On the upper end portion of the rotary shaft 8 there is installed a transmission pulley 13 which is connected with a power source (not shown in the drawing), while the lower end of the same shaft 8 extends to the vicinity of the lower end edge 12 of said stand pipe 5. Plural stirring blades 9 are radially fixed on the bottom face of a discoid fixing plate 14 which is installed on the lower end of the rotary shaft 8 and extends perpendicular to said shaft, as shown in FIG. 4.

Figure 2:
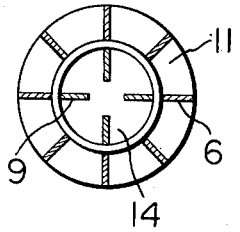
FIG. 2 is a cross-sectional view taken along the line II—II in FIG. 1.

The guide blades 6 and the stirring blades 9 are disposed in the manner illustrated in FIGS. 1 and 2; that is, they are practically on the same horizontal level and are perpendicular to the rotary shaft 8, said stirring blades 9 being located inside while said guide blades 6 are located surrounding the rotation zone of the stirring blades 9, and the direction of each guide blade 6 is normal to said rotary shaft 8. As to the number of the guide blades 6 and that of the stirring blades 9, they are not particularly limited: as for the guide blade 6, the number of blades can be appropriately modified as occasion demands and is usually in the range of – 24, and as for the stirring blade 9, it can be appropriately modified so as to decrease the number of rotations of the rotary shaft 8 correlatively with an increase of the number of blades 9. Further, as to the shape of said stirring blade 9, it may be provide with an exponential curve as occasion demands so as to attain acceleration. On the top face of the discoid fixing plate 14 for the stirring blades 9 there may be installed blades to serve as a balancer (not shown in the drawing) having a size smaller than the stirring blades 9. The foregoing varieties of modifications of design can be practiced individually or upon combining with one another as occasion demands. At the bottom of the tank 1 is installed the gas supply pipe 15 confronting the center of the fixing plate 14 which has said stirring blades 9 fixed thereto, and said pipe 15 is connected with a blower (not shown in the drawing).

Next, the sequence of operations performed by the foregoing apparatus embodying the present invention will be explained in the following.

Referring to FIG. 1, upon placing a specified fluid in the tank 1, the transmission pulley 13 is turned by means of a power source not shown in the drawing, whereby the stirring blades 9 are rotated in the tank 1 usually at a low speed of 100 – 300 m/min through the rotary shaft 8 while a gas is forcedly supplied from a blower not shown in the drawing through the gas supply pipe 15.

The gas supplied through the gas supply pipe 15 ascends and collide with the stirring blades 9 in motion thereby to be split into bubbles with relatively small diameter and radially sent out from the stirring blades 9 together with the fluid. When these bubbles reach the junction between the stirring blade 9 and the guide blade 6, they are further split into bubbles with lesser diameter by the shearing force generated between said blades 9 and 6, and thereafter dispersed radially and uniformly into the bubble-ascending zone A together with the fluid by the action of the guide blade 6. Bubbles thus dispersed in the ascending zone A together with the fluid separate from the current of fluid because of the relatively slow movement of the current of fluid, ascend while colliding with the surrounding solids, are adsorbed onto the surface of a specified solid, make said solid float and separate from other solids. Meanwhile, the fluid radially flowed out from the guide blades 6 into the bubble-ascending zone A circulates in a fixed flow pattern such as indicated by the arrow C by virtue of the pumping action of said stirring blades 9 together with the ascending current of fluid B generated by the gas being blown out toward said blades 9, and the kinetic energy of the fluid is absorbed and consumed in the vicinity of the bottom of the tank 1 and never disturb the stationary state within the bubble-ascending zone A.

In this connection, at the time when bubbles move from the stirring blades 9 toward the guide blades 6, a portion of said bubbles admittedly leak out through the gap between the fixing plates 11, 14 for both blades 9, 6 and enter the stand pipe 5, but inasmuch as the top of the stand pipe 5 is closed by means of the seal member 10, there is no fear of the occurrence of loss of bubbles due to the their escape to the outside.

The diameter of the foregoing bubbles can be controlled by changing the number of the guide blades 6, and the amount of bubbles can be adjusted to be usually in the range of 500 – 1000 l/min/m$^2$ by controlling the amount of gas to be blown in from the blower.

Figure 5:
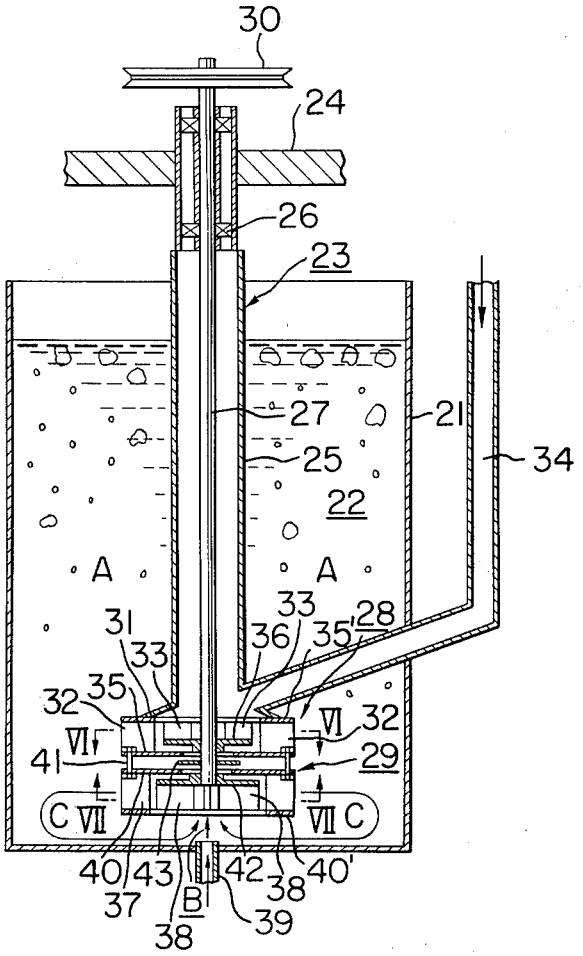
FIG. 5 is a vertical sectional view of the second embodiment of the present invention.

Next, illustrated in from FIG. 5 onward is the second embodiment of the present invention.

In FIG. 5, the reference numeral 21 denotes a tank, 22 denotes a liquid or a mixture of liquid and solid (with a volume of usually less than 3 cm$^3$f), and 23 denotes the main body of a bubble-dispersing apparatus which is installed within said tank 21 by means of the frame 24 installed above the tank 21.

The main body 23 is composed of a hollow cylindrical stand pipe 25, a rotary shaft 27 which is rotatably supported in said stand pipe 25 by means of a bearing 26, a solid-dispersing mechanism 28 which is provided on the lower part of said stand pipe 25 and rotary shaft 27, and a bubble-dispersing mechanism 29.

The lower end portion of the stand pipe 25 is expanded to form a trumpet-shape. On the upper end portion of the rotary shaft 27 is installed a transmission pulley 30 which is connected with a power source, while the lower end of the same shaft 27 extends to the vicinity of the lower end edge 31 of the stand pipe 25 expanded to form a trumpet-shape.

Figure 8:
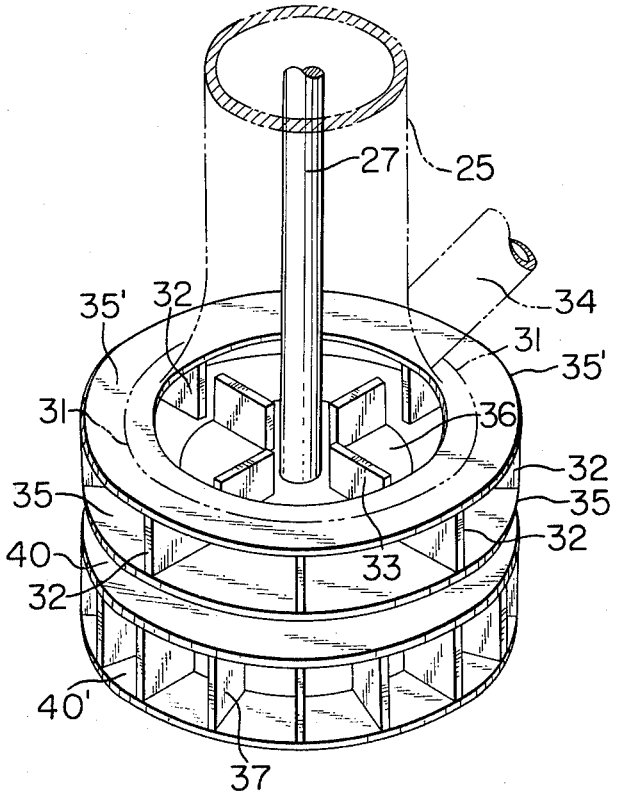
FIG. 8 is a perspective view, on an enlarged scale, of the assembly state of of the guide blades and stirring blades in the apparatus shown in FIG. 5.
Figure 9:
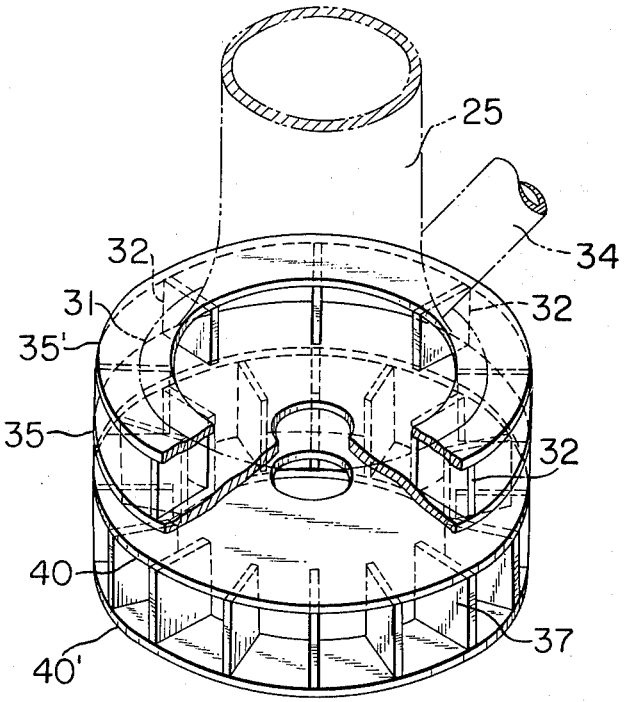
FIG. 9 is a perspective view, partially cut away, of the guide blades shown in FIG. 8.
Figure 10:
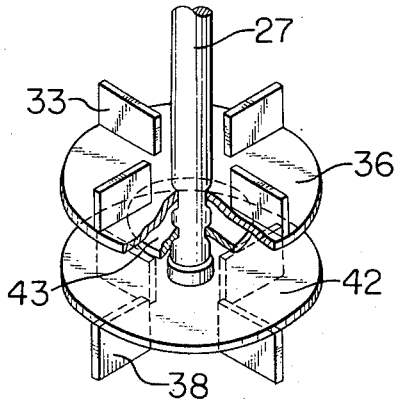
FIG. 10 is a perspective view, partially cut away, of the stirring blades shown in FIG. 8.

The solid-dispersing mechanism 28 consists of the first guide blades 32 installed at the lower end portion of said stand pipe 25. The first stirring blades 33 are installed on the lower end portion of said rotary shaft 27, and a solid supply pipe 34 which penetrates into said tank 21, is connected with said stand pipe 25 and open in front of said first stirring blades 33. A plurality of first guide blades 32 are radially fixed at regular intervals between a pair of annular fixing plates 35, 35′ which are placed one above the other with spacing therebetween in such a fashion as shown in FIGS. 8 and 9, and are integrally fixed to the lower end edge 31 of the stand pipe 25 through the upper plate 35′ of said pair of annular fixing plates. Meanwhile, the plural number of first stirring blades 33 are also radially fixed at practically equal intervals on the top face of the first discoid fixing plate 36 installed on the lower end portion of the rotary shaft 27 and extending perpendicular to said shaft in such a fashion as shown in FIGS. 8 and 10.

Figure 6:
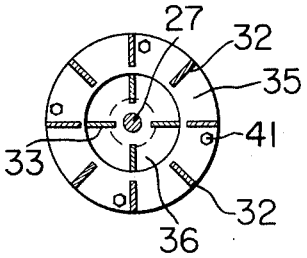
FIG. 6 is a cross-sectional view along the line VI—VI in FIG. 5.

These first guide blades 32 and first stirring blades 33 are disposed in such a fashion as illustrated in FIGS. 5 and 6; that is, they are practically on the same horizontal level perpendicular to the rotary shaft 27, the first stirring blades 33 are located inside while the first guide blades 32 are located surrounding the rotation zone of the first stirring blades 33, and the direction of each first guide blade 32 is normal to said rotary shaft 27. The inner circumferential portion of the annular fixing plate 35 and the outer circumferential portion of the first discoid fixing plate 36 overlap each other and leave a narrow space therebetween.

The bubble-dispersing mechanism 29 consists of the second guide blades 37 installed on the lower end portion of said stand pipe 25, the second stirring blades 38 installed on the lower end portion of said rotary shaft 27, and a gas supply pipe 39 which penetrates into said tank 21, opens to the face of the bottom of the second stirring blades 38 and is connected with a blower not shown in the drawings. A plurality of second guide blades 37 are radially fixed at regular intervals between a pair of annular fixing plates 40, 40′ which are placed one above the other with spacing therebetween in such a fashion as shown in FIG. 9, and the upper fixing plate 40 of said pair of annular fixing plates is integrally fixed to the fixing plate 35 for the first guide blade 32 through a separator 41. Meanwhile, a plurality of second stirring blades 38 are also radially fixed at practically equal intervals on the bottom face of the second discoid fixing plate 42 installed perpendicularly on the rotary shaft 27 beneath the fixing plate 36 for the first stirring blades 33.

Figure 7:
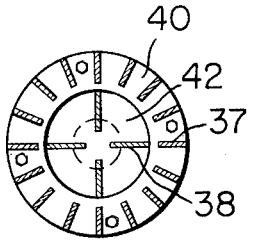
FIG. 7 is a cross-sectional view taken along the line VII—VII in FIG. 5.

These second guide blades 37 and second stirring blades 38 are disposed in such a fashion as illustrated in FIGS. 5 and 7; that is, like the relation between the first guide blades 32 and the first stirring blades 33, they are practically on the same horizontal level and are perpendicular to the rotary shaft 27, and second stirring blades 38 are located inside while the second guide blades 37 are located outside and surrounding zone of the second stirring blades 38, and the direction of each second guide blade 37 is normal to the rotary shaft 27. The inner circumferential portion of the annular fixing plate 40 and the outer circumferential portion of the second discoid fixing plate 42 overlap each other with a narrow space therebetween.

As to the number of the second guide blade 37, it is not particularly limited; it can be appropriately modified usually in the range of from 8 to 24. As to the number of the second stirring blade 38, it is not particularly defined by the present embodiment, either; it can be appropriately modified so as to decrease the number of rotations of the rotary shaft 27 correlatively with an increase of the number of blades 38. Further, as to the shape of the second stirring blade 38, it may be provided with an exponential curve as occasion demands so as to attain acceleration. As to the number of the first guide blade 32, on the other hand, it is not particularly limited, but in order to minimize the fluid discharge resistance and rectify the current of fluid, it is usual to modify said number appropriately within a narrower range of from 8 to 20 relative to the range for the second guide blades 37. As to the number of the first stirring blade 33, it is not particularly limited; it can be appropriately modified so as to increase the intake of solid by increasing the number of said first stirring blade 33. Further, as to the shape of the first stirring blade 33, it may be provided with an exponential curve. The top face of the second fixing plate 42 for the second stirring blades 38 and the bottom face of the first fixing plate 36 for the first stirring blades 33 may be equipped with blades to serve as the balancer which are smaller than the respective stirring blades 38 and 33.

The foregoing varieties of modifications of design can be selectively practiced individually or upon combining appropriately.

A dashboard 43 is installed between the fixing plates 36 and 42 for the respective stirring blades 33 and 38 by fixing same perpendicularly to the rotary shaft 27. This dashboard 43 is, as shown in FIG. 5, disposed so as to separate the fixing plates 35 and 40 for the respective guide blades 32 and 37 from each other. The number of the solid supply pipe 34 may be increased as occasion demands.

Next, the sequence of operations to be performed by the foregoing second apparatus embodying the present invention will be explained in the following.

Referring to FIG. 5, after placing a specified fluid in the tank 21, the transmission pulley 30 is turned by means of a power source not shown in the drawing, whereby the respective stirring blades 38 and 33 are rotated in the tank 21 usually at a low speed of 100 – 300 m/min through the rotary shaft 27, while a gas is forcedly supplied from a blower not shown in the drawing through the gas supply pipe 39 and solids are taken in the tank 21 through the solid supply pipe 34 by the pumping action of the rotating first stirring blades 33.

The gas supplied through the gas supply pipe 39 ascends and collides with the second stirring blades 38 in motion thereby to be split into bubbles with relatively small diameter and radially sent out from the second stirring blades 38 together with said fluid. When these bubbles reach the junction between the second stirring blade 38 and the second guide blade 37, they are further split into bubbles with lesser diameter by the shearing force generated between said blades 37 and 38, and thereafter dispersed radially and uniformly into the bubble-ascending zone A together with the fluid by the action of the second guide blades 37.

Bubbles thus dispersed in the ascending zone A together with the fluid come to separate from the current of fluid in the course of ascent because of the relatively slow movement of the current of fluid and ascends in the ascending zone A. Meanwhile, the current of fluid circulates in a fixed flow pattern such as indicated by the arrow C by virtue of the pumping action of the second stirring blades 38 together with the ascending current of fluid B generated by the gas being blown out toward said stirring blades 38, and the kinetic energy of the fluid is absorbed and consumed in the vicinity of the bottom of the tank 21 and never disturbs the stationary state within the bubble-ascending zone A.

Solids sucked up into the solid supply pipe 34 fall on the first stirring blades 33 to be stirred thereby, are sent out radially and uniformly toward the first guide blades 32, and are uniformly dispersed in the ascending zone A by the guide action of said blades 32. Immediately after entering the ascending zone A, solids collide with bubbles ascending from beneath, and a specific solid adsorbs bubbles onto the surface thereof, is separated from other solids, and floats.

In this connection, at the time when bubbles move from the second stirring blades 38 toward the second guide blades 37, some of said bubbles admittedly leak out through the gap between the fixing plates 40, 52 for both blades 37, 38, but the bubbles thus leaked are prevented form ascending by the dashboard 43 located above the gap so that there is no fear of their flowing outside through the stand pipe 25 via the space between the fixing plates 36 and 35 for the first stirring blade 33 and the first guide blade 32. Further, the diameter of said bubbles can be controlled by changing the number of the second guide blades 37, and the amount of bubbles can be adjusted to be usually in the range of 500 – 1000 l/min/m$^2$ by controlling the amount of gas to be blown in from the blower.

What is claimed is:

1. A bubble dispersing apparatus, comprising: a tank for containing a fluid and having a bottom wall and a peripheral side wall; a vertically extending rotatable shaft disposed in said tank and extending close to the bottom wall of the tank; a disc-like, impeller mounted on and fixedly attached to the lower end of said shaft for rotation therewith and extending substantially perpendicular thereto and substantially parallel to the bottom wall of the tank; a plurality of circumferentially spaced stirring blades attached to said impeller plate and extending vertically downwardly therefrom with the lower edges of said stirring blades extending substantially parallel to the bottom wall of the tank and being located close to but being spaced upwardly a short distance from the bottom wall of said tank to provide a clearance space therebetween, said stirring blades being arranged in a circular array about the axis of rotation of the shaft and being adapted for moving the fluid substantially horizontally and outwardly toward the side wall of the tank; upper and lower, parallel, stationary, annular, imperforate, fixing plates substantially coaxial with the axis of rotation of said shaft and in closely spaced, encircling relationship with the periphery of said impeller plate and said stirring blades; a plurality of linear, substantially uniformly circumferentially spaced-apart, radially extending, elongated, guide blades disposed between the stationarily supported on said upper and lower fixing plates and arranged in a circular array thereon, the assembly of said fixing plates and guide blades defining a cavity which has a central opening in its bottom, the assembly of said impeller plate and said stirring blades being disposed in said cavity for rotation therein, the assembly of said fixing plates and said guide blades being disposed at substantially the same horizontal level in said tank as the assembly of said impeller plate and said stirring blades with said guide blades being located in the flow path of the fluid from the stirring blades for guiding and directing the flow of the fluid radially outwardly toward the side wall of the tank at a horizontal level close to but spaced upwardly from the bottom wall of the tank, the lower surface of the imperforate lower fixing plate being located close to but spaced upwardly from the bottom wall of the tank and defining therewith a radially elongated continuation of said clearance space between said stirring blades and said bottom wall so that fluid directed outwardly from said guide blades can recirculate along the bottom wall of the tank through said clearance space to the underside of said stirring blades; and pipe means penetrating the bottom wall of the tank substantially directly under said stirring blades for supplying gas to the fluid being stirred by said stirring blades.

2. A bubble dispersing apparatus as claimed in claim 1, including a stationary vertical stand pipe surrounding said shaft and extending from above the tank to a location close to the lower end of said shaft, said stand pipe having a flared bottom portion, said upper fixing plate being secured to the lower end of said stand pipe.

3. A bubble dispersing apparatus, comprising: a tank for containing a fluid and having a bottom wall of peripheral side wall; a vertically extending rotatable shaft disposed in said tank and extending close to the bottom wall of the tank; a pair of vertically spaced, parallel, disc-like, impeller plates mounted on and fixedly attached to said shaft adjacent the lower end of said shaft for rotation therewith and extending substantially perpendicular thereto and substantially parallel to the bottom wall of the tank; a plurality of circumferentially spaced first stirring blades attached to the upper impeller plate and extending vertically upwardly therefrom, said first stirring blades being arranged in a circular array about the axis of rotation of the shaft; a first pair of upper and lower, parallel, stationary, annular, fixing plates substantially coaxial with the axis of rotation of said shaft and in closely spaced, encircling relationship with the periphery of said upper impeller plate and said first stirring blades; a plurality of linear, substantially uniformly circumferentially spaced-apart, radially extending first guide blades disposed between and stationarily supported on said first pair of upper and lower fixing plates and arranged in a circular array thereon, the assembly of said first pair of fixing plates and said first guide blades defining a cavity in which the assembly of said upper impeller plate and said first stirring blades is rotatably disposed, the assembly of said first pair of fixing plates and said first blades being disposed at substantially the same horizontal level in said tank as the assembly of said upper impeller plate and said first stirring blades; one or more first supply pipes extending to the central opening of the upper fixing plate of said first pair of fixing plates for supplying solids to said first stirring blades so that the solids can be dispersed in the fluid; a plurality of circumferentially spaced second stirring blades attached to the lower impeller plate and extending vertically downwardly therefrom with the lower edges of said second stirring blades extending substantially parallel to the bottom wall of the tank and being located close to but being spaced upwardly a short distance from the bottom wall of said tank to provide a clearance space therebetween, said second stirring blades being arranged in a circular array about the axis of rotation of the shaft and being adapted for moving the fluid substantially horizontally and outwardly toward the side wall of the tank; a second pair of upper and lower, parallel, stationary, annular, imperforate, fixing plates substantially coaxial with the axis of rotation of said shaft and in closely spaced, encircling relationship with the periphery of said lower impeller plate and said second stirring blades; a plurality of linear, substantially uniformly circumferentially spaced-apart, radially extending, elongated, second guide blades disposed between and stationarily supported on said second pair of upper and lower fixing plates and arranged in a circular array thereon, the assembly of said second pair of fixing plates and said second guide blades defining a cavity which has a central opening in its bottom, the assembly of said lower impeller plate and said second stirring blades being disposed in said cavity for rotation therein, the assembly of said second pair of fixing plates and said second guide blades being disposed at substantially the same horizontal level in said tank as the assembly of said lower impeller plate and said second stirring blades with said second guide blades being located in the flow path of the fluid from the second stirring blades for guiding and directing the flow of the fluid radially outwardly toward the side wall of the tank at a horizontal level close to but spaced upwardly from the bottom wall of the tank, the lower surface of the imperforate lower fixing plate of said second pair of fixing plates being located close to but spaced upwardly from the bottom wall of the tank and defining therewith a radially elongated continuation of said clearance space between said second stirring blades and said bottom wall so that fluid directed outwardly from said second guide blades can recirculate along the bottom wall of the tank through said clearance space to the underside of said second stirring blades; and pipe means penetrating the bottom wall of the tank substantially directly under said second stirring blades for supplying gas to the fluid being stirred by said second stirring blades.

4. A bubble dispersing apparatus as claimed in claim 3, including a stationary vertical stand pipe surrounding said shaft and extending from above the tank to a location close to the lower end of said shaft, said stand pipe having a flared bottom portion, said upper fixing plate of said first pair of fixing plates being secured to the lower end of said stand pipe.

* * * * *

UNITED STATES PATENT OFFICE
CERTIFICATE OF CORRECTION

Patent No. 3 984 001 Dated October 5, 1976

Inventor(s) Ikuo Nagano et al

It is certified that error appears in the above-identified patent and that said Letters Patent are hereby corrected as shown below:

Col. 7, line 66; change "impeller mounted" to ---impeller plate mounted---.

Col. 8, line 20; change "between the" to ---between and---.

Col. 8, line 23; change "and guide" to ---and said guide---.

Col. 8, lines 54 and 55; change "bottom wall of peripheral" to ---bottom wall and a peripheral---.

Col. 9, line 12; change "said first blades" to ---said first guide blades---.

Signed and Sealed this

First Day of February 1977

[SEAL]

*Attest:*

RUTH C. MASON
*Attesting Officer*

C. MARSHALL DANN
*Commissioner of Patents and Trademarks*